United States Patent [19]

Röck et al.

[11] Patent Number: 4,800,621

[45] Date of Patent: Jan. 31, 1989

[54] HINGE

[75] Inventors: Erich Röck, Höchst; Klaus Brüstle; Helmut Rupprechter, both of Lauterach, all of Austria

[73] Assignee: Julius Blum Gesellschaft m.b.H., Höchst, Austria

[21] Appl. No.: 184,770

[22] Filed: Apr. 22, 1988

Related U.S. Application Data

[63] Continuation of Ser. No. 939,439, Dec. 4, 1986, abandoned.

[30] Foreign Application Priority Data

| | | | |
|---|---|---|---|
| Dec. 10, 1985 | [AT] | Austria | 3569/85 |
| Feb. 10, 1986 | [AT] | Austria | 313/86 |
| Apr. 29, 1986 | [DE] | Fed. Rep. of Germany | 8611716[U] |

[51] Int. Cl.[4] ..... E05D 7/10

[52] U.S. Cl. ..... 16/235; 16/241; 16/250; 16/254; 16/270

[58] Field of Search ..... 16/235, 240, 241, 250, 16/254, 270, 272, 319, 324, 347, 349, DIG. 43; 29/11

[56] References Cited

U.S. PATENT DOCUMENTS

| | | | |
|---|---|---|---|
| 3,969,787 | 7/1976 | Röck et al. | 16/129 |
| 4,313,239 | 2/1982 | Tsuneki | 16/241 |
| 4,430,771 | 2/1984 | Salice | 16/235 |

FOREIGN PATENT DOCUMENTS

| | | | |
|---|---|---|---|
| 360856 | 2/1980 | Austria . | |
| 371205 | 6/1983 | Austria . | |
| 43903 | 5/1981 | European Pat. Off. . | |
| 2806958 | 8/1978 | Fed. Rep. of Germany . | |
| 2815816 | 10/1979 | Fed. Rep. of Germany | 16/240 |
| 3119571 | 12/1982 | Fed. Rep. of Germany . | |

*Primary Examiner*—M. Jordan
*Assistant Examiner*—Samuel M. Heinrich
*Attorney, Agent, or Firm*—Wenderoth, Lind & Ponack

[57] ABSTRACT

A hinge includes a hinge arm which is snappable onto a mounting plate by means of an intermediate member. The intermediate member is at the front thereof engageable with the mounting plate and at the rear thereof provided with a pivot lever having a hook member by means of which the pivot lever and the intermediate member are lockable on the mounting plate. Centering elements include, for example, a locking bolt extending into a notch in the mounting plate or noses which abut on a base member of the mounting plate.

16 Claims, 6 Drawing Sheets

1
9
6
6'
11
V
3
8
5
30
31
13
7
14
4
4'
19
28/21
15
A
10
2
2'
16
17
2''
20
2
21
28
3
30
20
19

HINGE

This application is a continuation of now abandoned application Ser. No. 939,439, filed Dec. 4, 1986.

FIELD AND BACKGROUND OF THE INVENTION

The invention relates to a hinge with adjusting means, in which a hinge arm is, by means of at least one intermediate member, fastenable to a mounting plate and, by means of hinge links, or the like, connected with a second hinge part, for example a hinge casing, the intermediate member being at one end engageable in the mounting plate and pivotable thereon by means of a pivot bearing, and at the other end lockable by means of a pivot lever which is pivotally mounted on the intermediate member and comprises a hook member engaging with a projection of the mounting plate.

In conventional hinges the hinge arm is fastened to the mounting plate by means of a clamping screw, such clamping screw generally extending through an elongated hole to allow an adjustment of the hinge arm in the direction of the depth of the piece of furniture.

Lately snap-in connections for fastening the hinge arm to the mounting plate have become known. DE-A-30 26 796 and DE-A-30 39 328, for example, show hinges with a hinge arm and a fastening plate in which the two parts to be locked snap together by inserting the hinge arm into a guide of the fastening plate and by displacing the same in a longitudinal direction. A similar way of locking a hinge arm to a mounting plate is described in DE-A-24 60 127. DE-A-32 41 284 shows a hinge in which the hinge arm is insertable into lateral guides of a mounting plate and clampable to the mounting plate by means of an eccentric.

The above-described ways of locking the hinge arm have the advantage that the hinge arm very quickly can be fixed to the mounting plate when the piece of furniture is being assembled, and that no tool is required for the mounting operation. This advantage is not unimportant because the door must be held while the hinge arms are mounted. When, for example, the door is held with one hand and the hinge arm is to be mounted with the other hand, a second person is frequently required who fastens the clamping screw with a screw driver, when the hinge arm is to be locked by means of a clamping screw.

It is a disadvantage of hinges in which the hinge arm or the intermediate member must be inserted into the mounting plate from the front that tilting frequently occurs. This is particulaly the case with high doors which carry many hinges.

AT-PS No. 360 856 describes a hinge whose intermediate member is engageable at one end in the mounting plate and at the other end is provided with a pivot lever by means of which the intermediate member is lockable to the mounting plate. The scope of the invention is to improve such a hinge.

The invention is based on the problem of holding the mounted hinge arm on the mounting plate without clearance as far as possible.

EP-A3-0 043 903 describes a hinge comprising a hinge arm which is adapted to be pushed onto a mounting plate and held by a catching lever acted upon by a spring. The spring and the catching lever press the hinge arm permanently against a stop of the mounting plate. It is a disadvantage of this arrangement that secure supporting of the hinge arm is dependent on the force of the spring and that the spring must continuously hold the hinge arm, i.e. over a period of many years.

SUMMARY OF THE INVENTION

It is the object of the invention to improve a hinge of the above-described type, whereby the clearance between the intermediate member and the mounting plate is reduced to the greatest possible extent without producing a continuous stress on the actual locking means.

According to the invention this is achieved by providing a positioning surface on the intermediate member which is staggered with respect to the pivot bearing in the direction of the depth of the piece of furniture, such positioning surface abutting a countersurface of the mounting plate when the intermediate member has been mounted on the mounting plate, and positioning and bracing the intermediate member, together with the pivot bearing, with respect to the mounting plate, preferably without clearance therebetween in the direction of the depth of the piece of furniture.

Since the hinge arm is positioned without clearance by means of rigid parts of the intermediate member and the mounting plate, the hinge arm is absolutely securely held over long periods of time. The spring which acts upon the pivot lever serves only to press the pivot lever behind a projection of the mounting plate during a mounting operation. The intermediate member is held on the mounting plate by positive locking.

An embodiment of the invention provides that the intermediate member has a nose or projection which lies behind the countersurface of the mounting plate when the intermediate member has been mounted on the mounting plate.

It may be provided that the intermediate member has a U-shaped cross section and that a nose or projection is formed at each lateral flange or leg of the intermediate member, and that the mounting plate has at each side thereof a base member defining a respective countersurface.

One embodiment provides that the nose is arranged adjacent to the hook member of the pivot lever.

To improve supporting of the intermediate member and to provide centering means, the lateral flanges of the intermediate member have recesses arranged directly in front of the noses and into which the base members of the mounting plate extend.

A further embodiment of the invention is characterized in that the stop surface is arranged on a locking bolt which lies transversly to the longitudinal center axis of the mounting plate and of the hinge arm, is mounted on the intermediate member and engages in a notch in the mounting plate, the wall of such notch forming the countersurface.

It is advantageously provided that the notch is semicircular and has plural, different radii. The notch is advantageously disposed in the rear half of the mounting plate.

The intermediate member with the locking bolt can be manufactured with a precision to reduce the clearance of the parts to an optimum extent.

It will be appreciated that the arrangement of the structural parts could also be reversed. Thus, the locking bolt could be formed at the mounting plate and extend into an opening in the intermediate member. According to the invention it is also possible to mount the pivot lever on the mounting plate with the hook member engaging the intermediate member.

To fix the intermediate member not only in the direction of the depth of the piece of furniture but also in the direction of the breadth of the door joint, a further embodiment provides that at the projection of the mounting plate, at the side remote from its mounting plane, there is provided a countersurface which is parallel to the mounting plane and that the hook member has a parallel positioning surface, so that the hook member and the positioning surface of the pivot lever snugly embrace the countersurface of the projection.

In this arrangement the countersurface may be provided as a cam of the projection.

It is advantageously provided that the hook member of the pivot lever is fork-shaped and comprises two prongs which laterally move past the cam when the pivot lever is being locked or released.

An embodiment of the invention provides two cams and that the hook member of the pivot lever extends between the cams when the pivot lever is being locked or released.

The pivot lever and the cam of the mounting plate can be manufactured with such a precision that the clearance of the parts is reduced to a minimum.

It is advantageously provided that laterally with respect to the cam or cams the projection of the mounting plate is provided with inclined surfaces which are parallel to the pivot axis of the pivot lever and inclined to the mounting plane of the mounting plate.

To improve the lateral supporting of the pivot lever at the mounting plate, an embodiment provides that the pivot lever has two cheeks or surfaces which receive between them the cam of the projection of the mounting plate.

BRIEF DESCRIPTION OF THE DRAWINGS

Two embodiments of the invention will now be described in more detail with reference to the accompanying drawings, in which.

Figure 1:
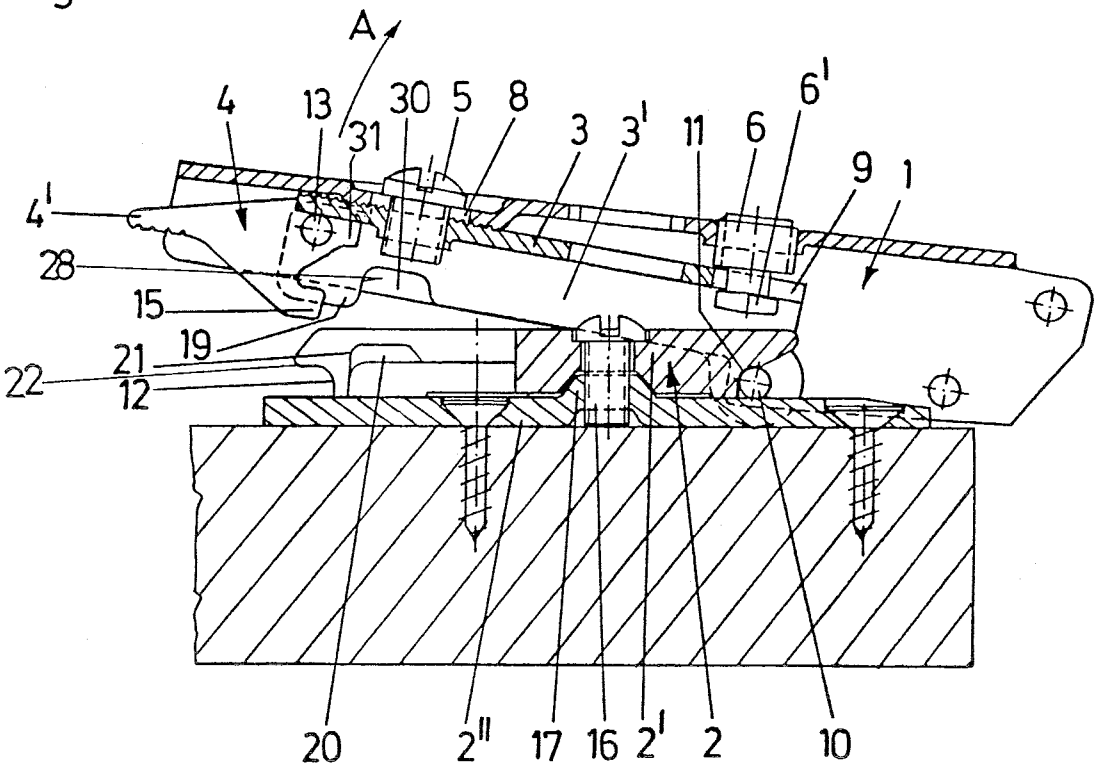
FIG. 1 is a longitudinal sectional view of a hinge arm and a mounting plate in a position with the hinge arm being engaged.

The hinge parts which are not directly related to the invention, such as a hinge casing and hinge links, are not shown in the drawings, because they are made according to the state of the art.

DESCRIPTION OF THE PREFERRED EMBODIMENTS

As can be seen from the drawings, the essential parts of the hinge are a hinge arm 1, a mounting plate 2 and an intermediate member 3 with a pivot lever 4.

The hinge arm 1 is fastened to the intermediate member 3 by means of a joint adjustment screw 6 which is mounted in a female thread in the hinge arm 1 and by means of a clamping screw 5 which also serves for depth adjustment. The clamping screw 5 projects through a slot 8 in the hinge arm 1, and the joint adjustment screw 6 has a head 6' held in a slot 9 in the intermediate member 3. By releasing the clamping screw 5, the hinge arm 1 can be displaced over the length of slot 8 and thus be adjusted in the direction of the depth of the piece of furniture. The adjustment in the direction of the door joint is effected in a conventional manner by turning the joint adjusting screw 6.

The intermediate member 3 has a U-shaped profile. The mounting plate 2 is inserted between legs 3' of the intermediate member 3.

At its front the intermediate member 3 is provided with a pin 10 which serves as a holding projection of the intermediate member 3. The mounting plate 2 has a notch at its front into which pin 10 is engageable to be held at the mounting plate 2. At its rear end the mounting plate 2 is also provided with a notch 12.

The pivot lever 4 is mounted at the rear end of the hinge arm 1 by means of a bolt 13. A hook member 15 is formed on the pivot lever 4.

The pivot lever 4 is acted upon by a spring so that, when the intermediate member 3 is mounted on the mounting plate 2, hook member 15 of the pivot lever snaps automatically into the notch 12.

The illustrated embodiment shows a leg spring 7 which is mounted in a recess 14 of the pivot lever 4 and has one end that abuts on the intermediate member 3.

Figures 2, 3:
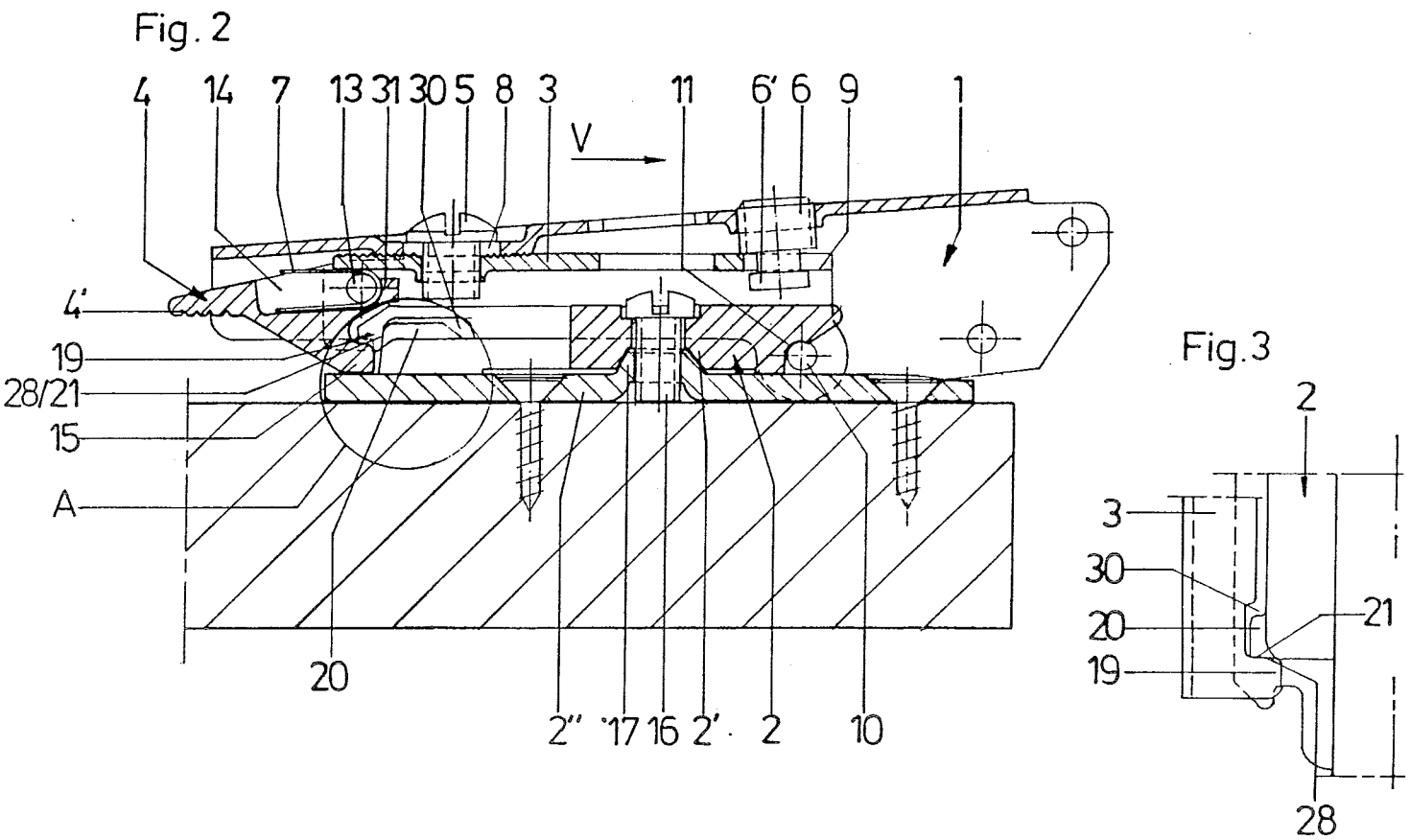
FIG. 2 is a longitudinal sectional view of the hinge arm and the mounting plate, with the hinge arm in a mounted position.
FIG. 3 is a side view of the mounting plate and of an intermediate member in a region of stops.

When the hinge arm 1 and the intermediate member 3 are pressed from the position illustrated in FIG. 1 into the position illustrated in FIG. 2, the hook member 15 engages in the notch 12 and the hinge arm 1 is locked to the mounting plate 2.

To avoid unintentional displacement of the hinge arm 1 in the forward direction, i.e. in the direction of arrow V of FIG. 2, the two lateral flanges or legs 3' of the intermediate member 3 are provided with respective protrusions or noses 19. When the hinge arm is in the mounted position, the noses 19 are positioned directly behind base members or projections 20 of the mounting plate 2 and advantageously abut with respective positioning surfaces 28 directly against respective countersurfaces 21 of the base members 20. In this arrangement the pivot lever 4 need only prevent the hinge arm 1 from being lifted from the mounting plate 2 in the direction of arrow A. This means that minimal forces only are received by the pivot lever. The great forces which act in the direction of arrow V are received between the noses 19 and the base members 20.

To facilitate and improve centering of the unit of hinge arm 1 and intermediate member 3 on the mounting plate 2, recesses 30 into which the base members 20 extend are provided directly in front of the noses 19.

The noses 19 and the base members 20 are positioned directly beside the hook member 15 of the pivot lever 4.

In the embodiment according to FIGS. 4 to 11, the intermediate member 3 has a locking bolt 18 which is positioned in the rear half of the length of intermediate member 3 and mounted between the legs 3' of the intermediate member 3. The outer surface of locking bolt 18 forms a positioning surface 28. When the intermediate member 3 has been mounted on the mounting plate 2, the locking bolt 18 comes to rest in a semicircular notch or recess 32 of the mounting plate 2. Centering of the intermediate member 3 on the mounting plate 2 is thus obtained and undesired clearance between the two parts is avoided. The front side surface of the notch 32 forms the countersurface 21. The locking bolt 18 corresponds in function to the noses 19 of the embodiment of FIGS. 1–3.

Figure 5:
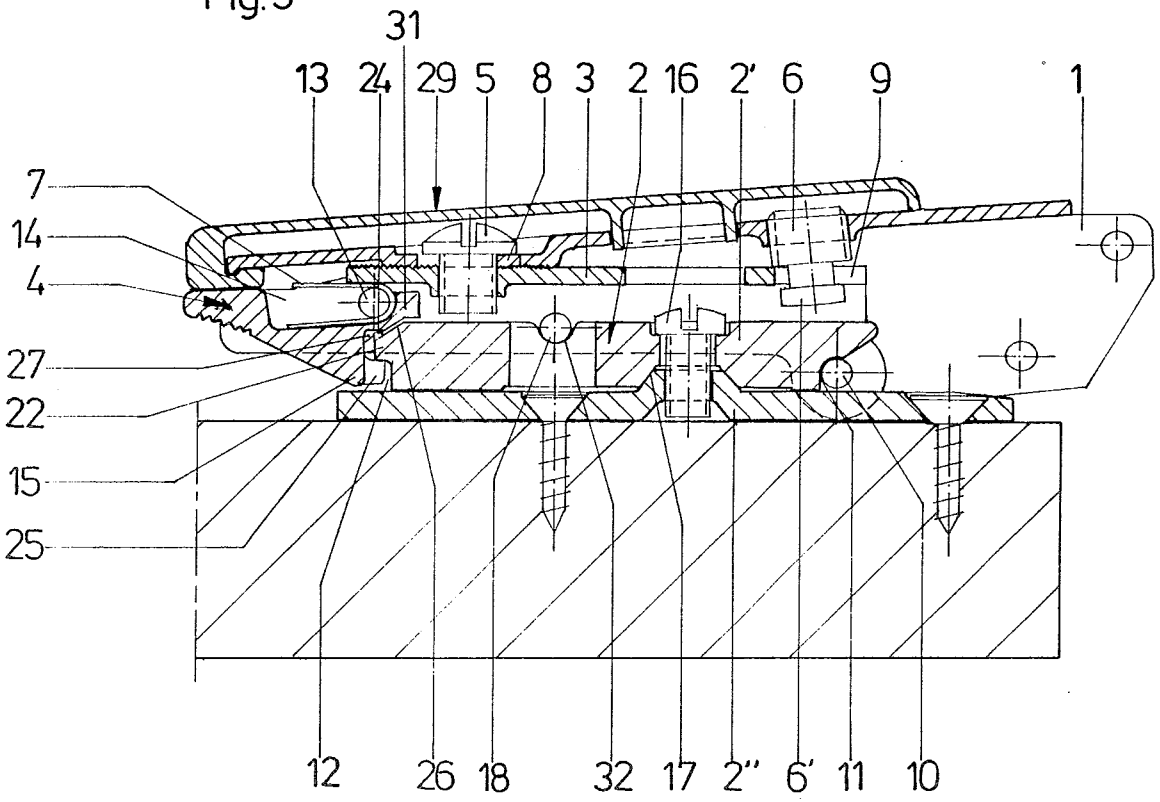
FIG. 5 is a longitudinal sectional view of the hinge arm and the mounting plate, with the hinge arm in a mounted position.
Figure 7:
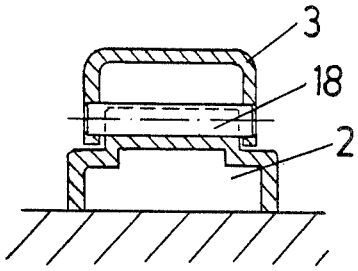
FIG. 7 is a sectional view along line A—A of FIG. 6.
Figure 6:
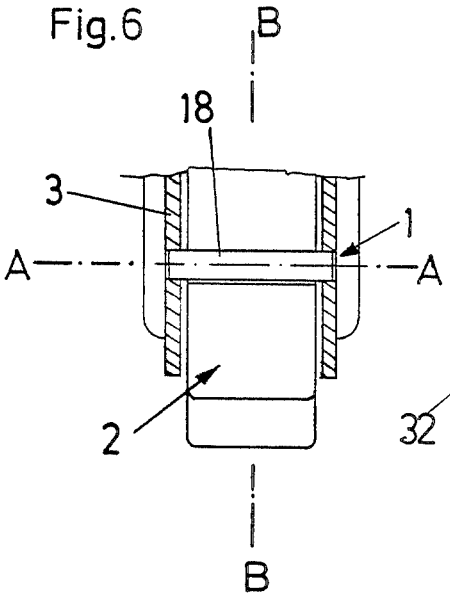
FIG. 6 is a horizontal sectional view of an intermediate member in the region of a locking bolt.
Figure 8:
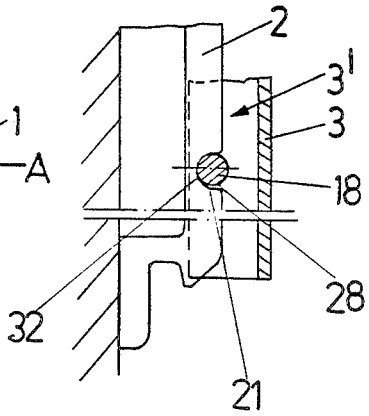
FIG. 8 is a sectional view along line B—B of FIG. 6.
Figure 9:
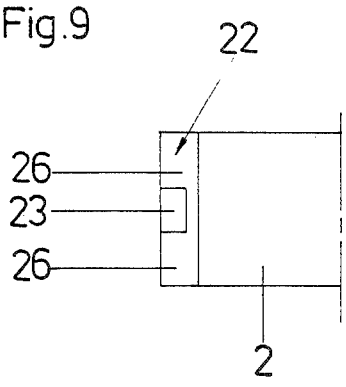
FIG. 9 is a top view of a mounting plate in the region of a projection with which a pivot lever engages.
Figure 10:
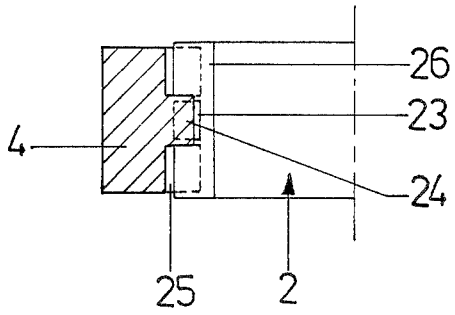
FIG. 10 is a partial horizontal sectional view of FIG. 5.

To facilitate engagement of the locking bolt 18, the notch 32 has, as particularly shown in FIG. 5, different radii. When the intermediate member 3 is in the mounted position, the locking bolt 18 rests snuggly against the front side surface 21 of notch 32.

After mounting of the hinge arm 1 on the intermediate member 3, the hinge arm 1 is adjusted in the above-described manner.

In both embodiments the centering part which carries the positioning surface 28 is a rigid part of the intermediate member 3.

A handle 4' is formed in the pivot lever 4. If the hinge arm 1 is to be released from the mounting plate 2, handle 4' is lifted, whereupon the hook member 15 disengages from the notch 12 and the hinge arm 1 and intermediate member 3 may be lifted from the mounting plate 2. such releasing operation is facilitated by a nose 31 on the pivot lever 4 that presses on the mounting plate 2 and acts like a lever. The locking bolt 18 can thus easily be released from the notch 32 even if there exists a certain bracing effect between the locking bolt 18 and the pin 10.

In this embodiment the hook member 15 of the pivot lever 4 is fork-shaped and has two legs or prongs 25. A projection 22 of mounting plate 2 is provided with a centrally arranged cam 23.

When the hinge arm 1 and the intermediate member 3 are being snapped onto the mounting plate 2, the prongs 25 of the hook member 15 move at both sides past the cam 23 and engage underneath projection 22. A countersurface or abutting surface 24 of the pivot lever 4 abuts a contact surface of the cam 23, such that the prongs 25 and abutting surface 24 of the hook member 15 snuggly embrace the cam 23 of the projection 22. The pivot lever 4 and hence also the intermediate member 3 and the hinge arm 1 are held at the rear end at the mounting plate 2 absolutely without clearance.

The intermediate member 3 is hence held at the mounting plate 2 by positive locking, not only in the direction of the depth of the piece of furniture, but also in the direction of the door joint.

Figure 11:
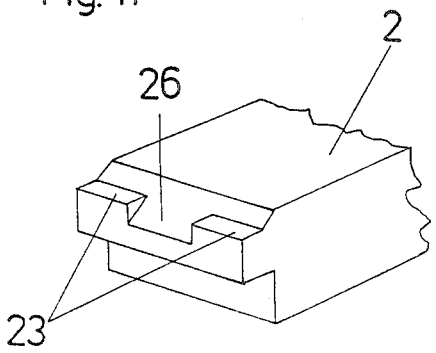
FIG. 11 is a perspective view of a mounting plate having two cams.

A reverse arrangement of the cam 23 and the prongs 25 of the hook member 15 would obviously also be possible. As shown in FIG. 11, two cams 23 could be arranged at the rear end of the mounting plate 2, and a single finger or projection of the hook member 15 could be passed between the cams 23 for locking and releasing the pivot lever. In this arrangement the hook member 15 would be T-shaped, when viewed from the front. To facilitate locking of the pivot lever 4, the projection 22 of the mounting plate 2 is provided with one (FIG. 11) or two (FIG. 9) inclined faces 26 which are aligned parallel to the pivot axis of the pivot lever, such pivot axis being formed by the journal 13 and faces 26 being inclined to the mounting plane of the mounting plate 2.

Figure 4:
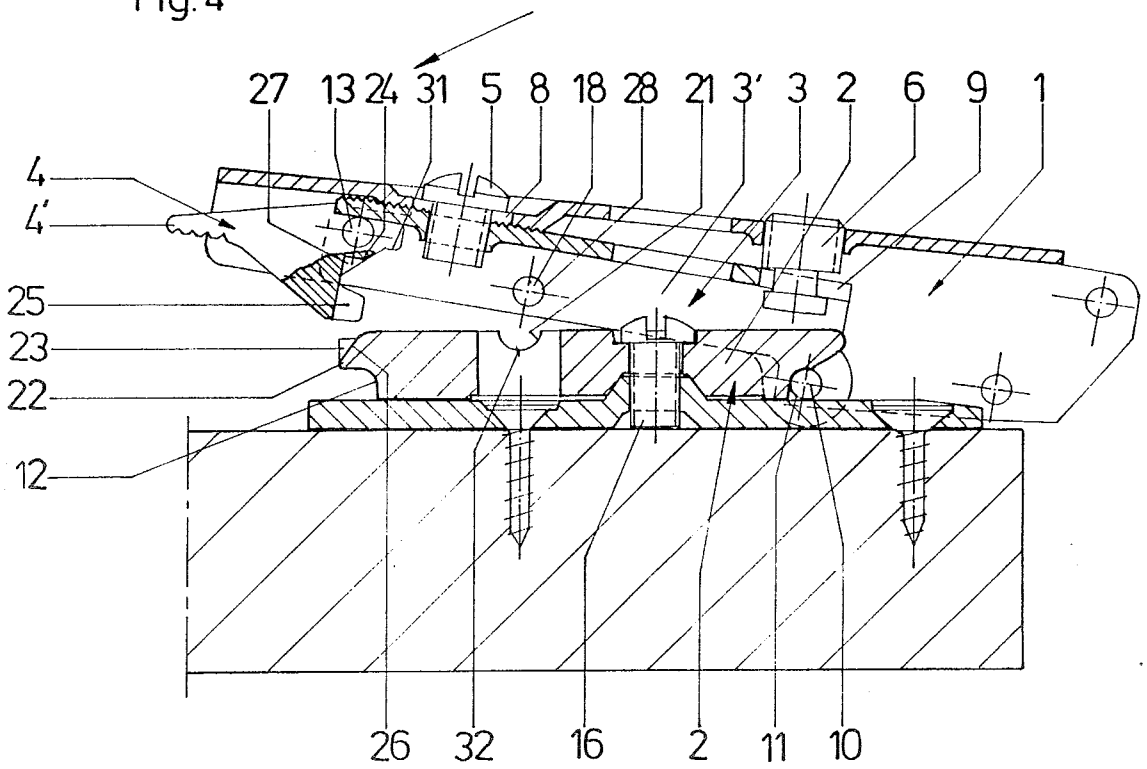
FIG. 4 is a longitudinal sectional view of a hinge arm and a mounting plate in a position with the hinge arm being engaged according to a second embodiment.

To improve lateral supporting of the pivot lever 4 at the mounting plate 2, the embodiment according to FIG. 4 provides lateral cheeks or surfaces 27 on the pivot lever 4, cheeks receiving cam 23 between them, when the intermediate member 3 is mounted on the mounting plate 2.

For vertical adjustment of the hinge arm a clamping screw 16 is released, and an upper part 2' of the mounting plate 2 is displaced relative to a lower part 2''. Guides 17 prevent tilting of the hinge arm 1. After vertical adjustment the clamping screw 16 is fastened.

The hinge arm 1 may be covered by a cover member 29 (FIG. 5).

The terms upper, lower and lateral used in this specification do not relate to the hinge in the mounted position at the piece of furniture but to the relative orientations of the drawings.

What is claimed is:

1. In a hinge including a mounting plate, a hinge arm to be linked to another hinge part, and an intermediate member supporting said hinge arm for mounting said hinge arm on said mounting plate, said intermediate member having a first end pivotally engageable with said mounting plate such that said intermediate member is pivotable about a pivot axis with respect to said mounting plate, and said intermediate member having pivotally mounted on a second end thereof a pivot lever having a hook member engageable with a projection of said mounting plate for fastening said intermediate member to said mounting plate, the improvement comprising means, operable in cooperation with the pivotal engagement between said first end of said intermediate member and said mounting plate, for, when said intermediate member is fastened to said mounting plate, bracing said intermediate member with respect to said mounting plate without substantial clearance therebetween in a direction transverse to said pivot axis and extending therefrom toward said second end of said intermediate member, said bracing means comprising:

a positioning surface on said intermediate member at a position spaced in said direction from said pivot axis;

a countersurface on said mounting plate; and said positioning surface abutting said countersurface when said intermediate member is fastened to said mounting plate.

2. The improvement claimed in claim 1, wherein said positioning surface is formed on a protrusion of said intermediate member that is positioned further from said pivot axis than said countersurface when said intermediate member is fastened to said mounting plate.

3. The improvement claimed in claim 2, wherein said countersurface is formed on a base member of said mounting plate.

4. The improvement claimed in claim 3, wherein said intermediate member has a U-shaped configuration including two spaced lateral flanges, each said lateral flange has a respective said protrusion defining a respective said supporting surface, and said mounting plate has on each of opposite sides thereof a respective said base member defining a respective said countersurface.

5. The improvement claimed in claim 4, wherein said protrusions are positioned adjacent said hook member.

6. The improvement claimed in claim 4, wherein each said lateral flange has therein a recess at a position directly adjacent the respective said protrusion and closer to said pivot axis than said respective protrusion, and said base members extend into respective said recesses when said intermediate member is fastened to said mounting plate.

7. The improvement claimed in claim 1, wherein said positioning surface is formed on a locking bolt on said intermediate member and extending parallel to said pivot axis, said locking bolt extending into a recess of said mounting plate when said intermediate member is fastened to said mounting plate, said countersurface being formed by a surface of said recess.

8. The improvement claimed in claim 7, wherein said recess is located at a position more than half-way between said pivot axis and said projection in said direction.

9. The improvement claimed in claim 7, wherein said recess is substantially semicircular and is defined by merging surfaces of different radii.

10. The improvement claimed in claim 1, wherein said projection of said mounting plate includes a contact surface spaced from and extending parallel to the mounting plane of said mounting plate, and said hook member has an abutting surface complementary to and abutting said contact surface when said hook member engages said projection.

11. The improvement claimed in claim 10, wherein said contact surface is located on a cam member extending from said projection.

12. The improvement claimed in claim 11, wherein said hook member is fork-shaped and includes two legs extending on opposite sides of said cam member when said hook member engages said projection.

13. The improvement claimed in claim 11, comprising two said cam members extending from said projection, said hook member extending between said two cam members when said hook member engages said projection.

14. The improvement claimed in claim 11, wherein said projection includes at least one inclined surface laterally adjacent said cam member, said inclined surface being inclined relative to said contact surface and extending parallel to the pivot axis of said pivot lever.

15. The improvement claimed in claim 11, wherein said pivot lever has two lateral surfaces receiving therebetween said cam member when said hook member engages said projection.

16. In a hinge including a mounting plate, a hinge arm to be linked to another hinge part, and an intermediate member adjustably supporting said hinge arm for mounting said hinge arm on said mounting plate, said intermediate member having a U-shaped configuration defined by two side flanges joined by a web, a pin mounted between said two side flanges at a first end of said intermediate member, said pin fitting into a recess of said mounting plate and thereby forming a pivot axis about which said intermediate member and said hinge arm are pivotable with respect to said mounting plate, said intermediate member having pivotally mounted on a second end thereof a pivot lever having a hook member engageable with a projection of said mounting plate for fastening said intermediate member to said mounting plate, and spring means for urging said pivot lever to a position such that said pivot lever thereof engages said projection of said mounting plate, the improvement comprising means, operable in cooperation with the pivotal engagement between said first end of said intermediate member and said mounting plate, for, when said intermediate member is fastened to said mounting plate, bracing said intermediate member with respect to said mounting plate without substantial clearance therebetween in a direction transverse to said pivot axis and extending therefrom toward said second end of said intermediate member, said bracing means comprising:

a positioning surface on said intermediate member at a position spaced in said direction from said pivot axis;

a countersurface on said mounting plate; and said positioning surface abutting said countersurface when said intermediate member is fastened to said mounting plate.

* * * * *